United States Patent [19]

Okin

[11] Patent Number: 4,679,273

[45] Date of Patent: Jul. 14, 1987

[54] DENTAL APPLIANCE FOR CLEANSING THE GINGIVAL ONE THIRD AREAS OF THE TEETH AS WELL AS THE SULCULAR AND THE EMBRASURE REGIONS THEREOF

[76] Inventor: Seth Okin, 6 Tuddington Rd., Great Neck, N.Y. 11023

[21] Appl. No.: 919,598

[22] Filed: Oct. 17, 1986

Related U.S. Application Data

[63] Continuation-in-part of Ser. No. 766,508, Aug. 19, 1985, abandoned.

[51] Int. Cl.[4] ..... A46B 9/04

[52] U.S. Cl. ..... 15/167 R; 15/110; 128/62 A; D4/104

[58] Field of Search ..... 15/167 R, 110, 143 R; 128/62 A; D4/104–106

[56] References Cited

U.S. PATENT DOCUMENTS

| | | | |
|---|---|---|---|
| 1,770,195 | 7/1930 | Burlew . | |
| 1,943,225 | 1/1934 | McIntyre . | |
| 2,038,217 | 6/1937 | Brothers et al. . | |
| 2,117,174 | 5/1938 | Jones . | |
| 2,290,894 | 7/1932 | Rivanov . | |
| 2,483,503 | 10/1949 | Pollack . | |
| 2,834,344 | 5/1958 | Masakunikanai . | |
| 2,946,072 | 7/1960 | Filler et al. . | |
| 3,188,673 | 6/1965 | Newman | 15/167 R |
| 3,229,318 | 1/1966 | Clemens . | |
| 3,731,336 | 5/1973 | Rubin . | |
| 4,081,877 | 4/1978 | Vitale . | |
| 4,274,174 | 6/1981 | Ertel . | |
| 4,356,585 | 11/1982 | Protell et al. . | |
| 4,542,552 | 9/1985 | D'Argembeau | 15/167 R |

*Primary Examiner*—Peter Feldman

*Attorney, Agent, or Firm*—David M. Rosenblum

[57] ABSTRACT

The present invention provides a dental appliance for cleansing the gingival one third areas of the teeth, the sulcular regions and the embrasure regions. The dental appliance of the present invention is in the form of a tooth brush having a brush head portion a handle portion and a neck portion. A plurality of tufts of bristles are connected to the brush head portion, preferably in a single row. The tufts form an undulating brushing surface having a plurality of alternating convex and concave regions. The convex regions are configured to coincide with portions of the free gingival margin adjacent to the facial surfaces of selected teeth and the concave regions are configured to coincide with the interproximal margins between the teeth selected in configuring the convex regions. As a result of the coincidence, the aforementioned areas of the teeth and gingivae can be efficiently cleaned.

In order to permit easy manipulation of the appliance within the oral cavity, the brush head portion is cylindrical. The handle portion is angled back from the brushing surface and the mean height of the bristles increases towards the handle portion to permit the brush head portion to be held in a level orientation anywhere in the mouth for efficient brushing. All tufts of bristles are rounded to prevent irritation of the gingivae. Adjacent tufts of bristles touch one another at the fomed brushing surface to maximize the area of the brushing surface.

11 Claims, 4 Drawing Figures

DENTAL APPLIANCE FOR CLEANSING THE GINGIVAL ONE THIRD AREAS OF THE TEETH AS WELL AS THE SULCULAR AND THE EMBRASURE REGIONS THEREOF

This is a continuation-in-part of co-pending application Ser. No. 766,508, filed Aug. 19, 1985, now abandoned.

FIELD OF THE INVENTION

This invention relates to dental appliances and more particularly to tooth brushes. Still even more particularly the present invention relates to a tooth brush having a brushing surface that coincides with portions of the free gingival margin of the gingivae that is situated directly adjacent to the gingival one third areas of the teeth to cleanse such areas of the teeth as well as the sulcular and embrasure regions thereof.

BACKGROUND OF THE PRIOR ART

As will be described in greater detail hereinafter those portions of healthy gum tissue or gingivae that are situated directly adjacent to the teeth normally have an undulating configuration. This undulating configuration of the gingivae is referred to as the free gingival margin. The free gingival margin overlaps the crowns of the teeth. The fissures formed between the overlapping free gingival margin and the teeth are referred to as the sulcular regions. The gingival one third area of each tooth comprises one third of the facial surface of the crown thereof, including the portion of the crown underlying the sulcular region, that is located closest to the gingiva. The embrasure regions, that are located between the teeth, consist of the interdental papillae and the interproximal margins of the teeth. The cleansing of these above described facial areas of the teeth and the adjacent, associated gingivae, is normally neglected during ones daily regimen of oral hygiene. As a result of such neglect, the teeth and the gingivae suffer from a greater probability of decay and disease.

The reason for such neglect relates to the shape and configuration of conventional tooth brushes. As is well known in the prior art, conventional tooth brushes generally have level, planar brushing surfaces. Since, as described above, the gingivae directly adjacent to the teeth have an undulating configuration, the level, planar brushing surfaces of conventional tooth brushes generally do not clean the facial surfaces of the teeth that are proximately located with respect to the gingivae, as well as the associated sulcular regions thereof. Even when one takes special care to reach such surfaces with a conventional tooth brush, an irritation of the gingivae can result from the rubbing action of the bristles of the tooth brush across the gingivae. Another difficuly in cleansing such regions of the teeth arises from the decrease in the available vestibular area between the teeth and the oral cavity that is normally encountered towards the back of the oral cavity. The sulcular regions of the gingivae are also neglected simply because the flat brushing surface of a conventional tooth brush never reaches within the overlap of the sulcular regions. Lastly, the inline orientation of the handle of a conventional tooth brush with respect to its brushing surface inhibits the user from holding the brush head portion in a level orientation with respect to the gingival one third areas and the associated gingivae. This results in decreased brushing efficiency in that during brushing only a portion of the bristles are in contact with the facial surfaces of the teeth at any location in the oral cavity.

The need to cleanse such areas of the teeth and gingivae has long been known in the prior art. For instance in one tooth brush of the prior art, a brush head portion is provided having an outer set of bristles of uniform length and a central, intermediate set of bristles having a length less than that of the outer set of bristles. As a result, at least some bristles are operable for reaching the gingival one third areas the teeth. Another tooth brush of the prior art employs tufts of bristles having alternating lengths and tufts of bristles transversely angled towards one another. The longer bristles can thereby extend into the interproximal areas of the teeth and the crevices and depressions thereof. The adjacent, shorter tufts of bristles provide motility to the longer tufts of bristles during the cleansing of such areas of the teeth. Although such tooth brushes represent an advance over the conventional tooth brushes for cleansing the teeth and at least the interproximal regions thereof, they also have a built in design deficiency in that the regular and equal arrays of the bristles thereof do not equally cleanse all of the teeth. This is because teeth vary in size. For instance molars are larger than incisors and as such the gingival one third area of a molar is larger than that of an incisor. Additionally, the brush head portions and handles thereof are very similar in size and arrangement to conventional tooth brushes and as a result they retain the inherent problems thereof in cleansing the teeth that are situated towards the back of the oral cavity.

As will be discribed hereinafter the tooth brush of the present invention seeks to remedy the problems associated in cleaning the gingival one third areas of the teeth and the sulcular and embrasure regions by providing a tooth brush having an undulating brushing surface of convex and concave regions of tufts of bristles wherein the convex regions of the tufts of bristles differ from one another in size and curvature to coincide with the free gingival margin that is located adjacent to selected teeth. Additionally, the brush head portion itself can preferably contain a single row of bristles on a narrow cylindrical brush head portion to reach into the rearmost areas of the oral cavity. An angled handle portion is also provided, which in combination with an angled brushing surface, permits the brushing surface to remain level and in complete contact with the teeth during brushing.

SUMMARY OF THE INVENTION

In accordance with the present invention there is provided a dental appliance for cleansing the gingival one third areas of the teeth of a user as well as the sulcular and the embrasure regions thereof. The dental appliance of the present invention includes a brush head portion, a plurality of tufts of bristles, a handle portion and a neck portion.

The brush head portion is of elongate configuration. It has a proximal end, a distal end and a length as measured from the distal end to the proximal end. The plurality of tufts of bristles are disposed along the length of the brush head portion in a single plane. Each of the tufts of bristles are connected at one end to the brush head portion. The tufts of bristles are sized so as to define an undulating brushing surface formed from the other of the ends of the tufts of bristles.

The brushing surface includes a plurality of convex and concave regions. Each of the convex regions is configured to coincide with a portion of the free gingival margin adjacent to the facial surface of an average, adult tooth. The convex regions include at least one which is located at the distal end of the brush head portion and which is configured to coincide with a portion of the free gingival margin adjacent to the facial surface of an average, adult molar. The concave regions are located adjacent to and alternate with the convex regions of the tufts of bristles. The concave regions of the tufts of bristles are configured to coincide with the average of the interproximal margins of the teeth used in configuring the convex regions of the tufts of bristles located on either side thereof. The concave region located adjacent to the one convex region at the distal end of the brush head portion has the configration of the average interproximal margin that is located between adult molar teeth. The mean height of the brushing surface, as measured in a direction normal to the brush head portion, increases from the distal end of the brush head portion to the proximal end of the brush head portion.

The handle portion is also of elongate configuration. The handle portion is connected to brush head portion at the proximal end thereof.

The neck portion connects the handle portion to the brush head portion.

BRIEF DESCRIPTION OF THE DRAWINGS

While the specification concludes with claims particularly pointing out and distictly claiming the subject matter which is regarded as the present invention, it is believed that the invention will be better understood from the following description taken in connection with the accompanying drawings in which:

DESCRIPTION OF THE PREFERRED EMBODIMENT

Figure 1:
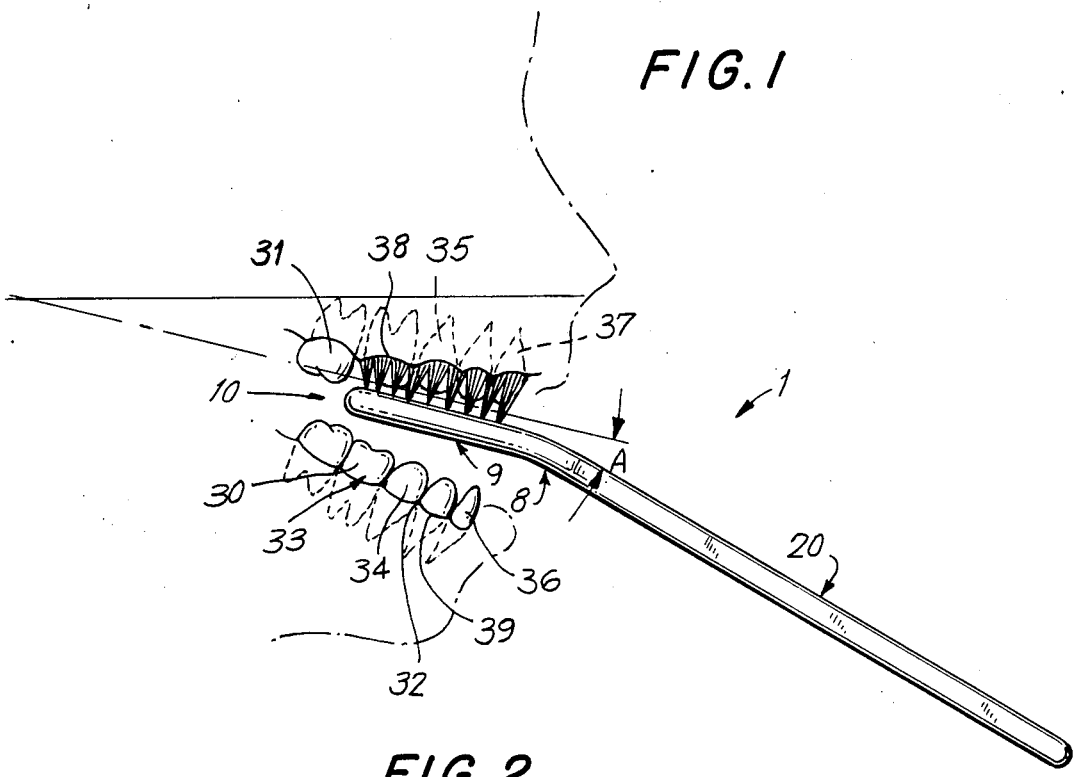
FIG. 1 is an elevational view of the dental appliance of the present invention in use in a partial, crossectional view of an oral cavity.

Referring now to FIG. 1, the dental appliance 1 of the present invention is illustrated in use in an oral cavity of an adult human being. Illustrated in the oral cavity are the teeth in an adult human being which normally comprise the molars, the premolars and the incisors. In FIG. 1, typical lower and upper molars are illustrated as 30 and 31, typical lower and upper premolars are illustrated as 34 and 35 and typical upper and lower, central incisors are illustrated as 36 and 37. A gingival one third of a tooth is typically illustrated for lower molar 30 by reference number 33. The upper and lower free gingival margins are illustrated by respective reference numbers 38 and 39. An interdental papillae is typically illustrated at reference number 32. The gingival margins, 38 and 39, overlap the gingival one third areas of the teeth. The fissure created by this overlap between the gingivae and the tooth is commonly referred to as the gingival sulcus or the sulcular region.

As illustrated in the Figures, the dental appliance of the present invention preferably comprises a brush head portion 9, a plurality of tufts of bristles 12*a*, 12*b*, 12*c*, 12d, 14*a*, 14*b*, 16*a*, 16*b*, and 16*c*. A handle portion 20 is provided which is preferably angled away from the aforementioned tufts of bristles. A neck portion 8 connects the handle portion 20 to the brush head portion 9.

Figure 2:
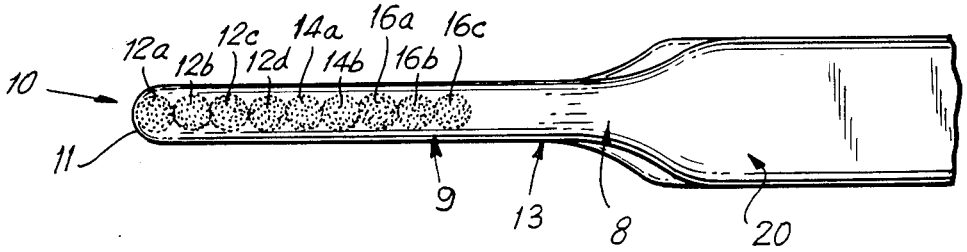
FIG. 2 is an enlarged, fragmentary bottom plan view of the brush head portion of the dental appliance of FIG. 1.
Figure 3:
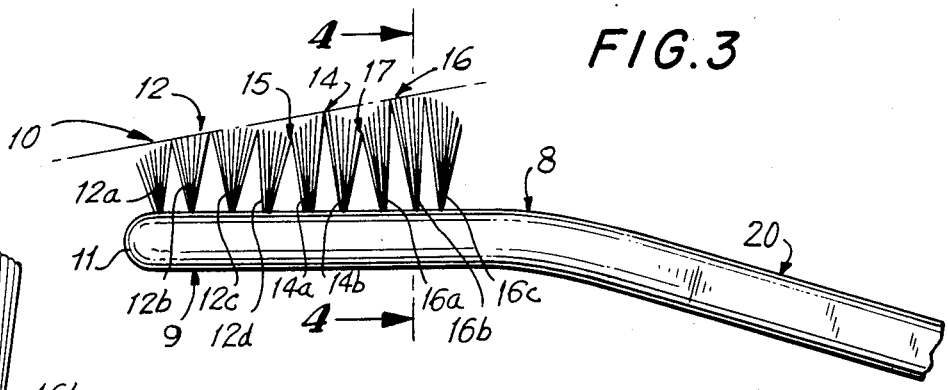
FIG. 3 is an enlarged, fragmentary left side elevational view of dental appliance of FIG. 1.
Figure 4:
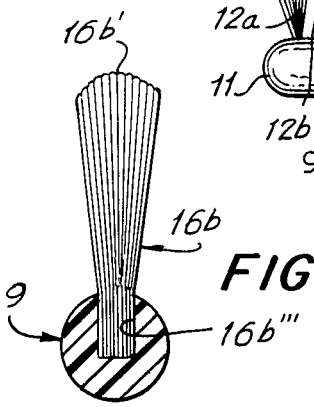
FIG. 4 is a crossectional view of the dental appliance of FIG. 1 taken along line 4—4 of FIG. 3.

Referring now to FIGS. 2 and 3, brush head portion 9 is of elongate configuration and has a distal end 11 and a proximal end 13. With reference to FIG. 4 it can be seen that the brush head portion 9 preferably has a circular crossection and is thus of cylindrical configuration. In the preferred embodiment, the brush head portion 9 can have a diameter of between about 3 mm. to about 4 mm. and a length of about 25 mm. This configuration for the brush head portion 9 is preferred in that it allows the user to more readily manipulate the brush head portion 9 within the small confines resulting from the aforementioned decrease in vestibular area between the gingivae and the cheek of the user that is normally encountered towards the back of the oral cavity. The brush head portion 9 could of course have other crossectional configurations, such as an ellipse. However in such case the minor axis of such elipse can be between about 2 mm. to about 3 mm. and the major axis can be about 3 mm. to about 4 mm.

Referring now to FIGS. 3 and 4 the preferred brush head portion 9 of the present invention has a plurality of tufts of bristles disposed along the length of the brush head portion 9 in a single plane. The tufts of bristles are sized such that the other ends define an undulating brushing surface 10 along the length of brush head portion 9. The undulating brushing surface 10 preferably has a set of three convex regions 12, 14 and 16 and a set of two concave regions 15 and 17. The concave regions alternate with the convex regions and are located adjacent thereto. The convex regions 12, 14 and 16 have configurations that coincide with portions of the free gingival margin of the gingivae in an adult user. Since the bristles have the configuration of the free gingival margin, they can easily access the gingival one third areas of the teeth and reach into the gingival sulcus to clear the same of plaque and debris. The portions of the free gingival margin selected in the present invention represent a compromise given the limitation in the available length of a brush head portion 9. Thus, in the preferred embodiment, portions of the free gingival margin adjacent to facial surfaces of selected teeth were chosen such that at least a portion of the brush head portion 9 is sized to fit within the gingival one third area of any tooth. In the preferred embodiment the selected teeth were a first molar, the lower, central incisor and the upper, central incisor. Therefore, the convex region of bristles 12 coincides with the free gingival margin adjacent to the facial surfaces of a first molar, the convex region of bristles 14 coincides with the free gingival margin adjacent to a the facial surfaces of a lower, central incisor, and the convex region 16 coincides with the free gingival margin adjacent to the facial surfaces of a central, upper incisor. All of the selected teeth and free gingival margin are of an adult user. As can well be appreciated, tooth size varies between individuals. Therefore, average configurations were chosen. Although not preferred, it is possible to select different teeth or even more teeth for more convex and concave regions. However, since the distal end 11 of the brush head portion 9 normally is used to reach teeth towards the back of the oral cavity, there should be a convex region at the distal end such as 11. Moreover, this convex region should preferably have the configuration of the free gingival margin that is located adjacent to the facial surfaces of an average, adult molar. Since molars, both upper and lower, are of about the same size any molar could be selected. However, since most people retain their first molars throughout their lives, the molar selected is preferably a first molar (Either upper or lower).

The interproximal margins of the teeth were utilized in configuring the concave regions 15 and 17. It has been found that this configuration of the concave regions 15 and 17 are operable for cleaning the embrasure areas without irritation thereof. Since it is required that the convex region of bristles 12 have the configuration of the free gingival margin adjacent to the facial surfaces of a molar it is also required that the concave region 15 be given the configuration of the interproximal margins between molars. This could be alternately specified as the interproximal margins between the molars and a bicuspid in that the configuration of this interproximal margin is about the same as for molars. Since in the preferred embodiment the central incisors were chosen as the selected teeth for configuring convex regions 14 and 16, the concave region of bristles, 17 located between regions 14 and 16 can preferably have the configuration of the interproximal margin between central incisors. In this regard, the interproximal margin between upper and lower incisors is about the same. Generally speaking however, the concavities of a possible embodiment, other than the one (Concave region 15) that is required to be located directly adjacent to the convexity 12 at the distal end 11 of the brush head portion 9, can preferably be the average of the interproximal margins between the teeth used to configure such convexities. Again, since it is only possible to deal in average size within any large population of individuals, the concave regions of a another possible embodiment (Though less preferred) of the present invention can have the average configuration of the selected, interproximal margins of an adult user.

As can best be seen in FIG. 4, the other, unattached ends of each bristle and of the tufts of bristles are rounded. This is typically illustrated for tuft **16*b* in which end 16*b*' and each bristle thereof have a rounded configuration. The purpose of such a rounded configuration is to decrease the possiblity of gum irritation when the dental appliance 1 of the present invention is in use. As illustrated in FIG. 3, the tufts of bristles spread radially in an outward direction. Each adjacent tuft of bristles touch one another at their unconnected ends. For instance, tuft 12*a* touches tuft 12*b*** at their unconnected ends. The purpose of the adjacent touching of the tufts is to provide as large a brushing surface as possible.

As illustrated in the Figures, the tufts of bristles **12*a*, 12*b*, 12*c*, 12*d*, 14*a*, 14*b*, 16*a*, 16*b* and 16*c* are arranged in a single row. However, it is understood that the bristles could include multiple rows of tufts of bristles in the same manner as a conventional tooth brush. The disadvantage of such contruction would be to increase the width of brush head portion 9**, which would in turn increase the difficulty that the user normally encounters in cleansing gingival one third areas that are located towards the back of the oral cavity because of the space limitations in the aforementioned vestibular area thereof.

In order to allow the user to properly cleanse the gingival one third areas of the teeth and the associated gingivae, it is important that the brush head 9 of the present invention be held in a level orientation such that all of the bristles are in contact with the gingival one third areas and the associated gingivae. In conventional tooth brushes, when the user attempts to brush the molars, while at the same time holding the brush head in a level orientation, the handle thereof can collide with the teeth situated towards the front of the oral cavity. The reason for this is that the mandible and the maxilla of an individual is vertically thicker towards the front of the oral cavity and hence, the teeth extend further into the oral cavity towards the frontal portions thereof. A similar problem arises when the user attempts to brush the teeth situated in the front of the oral cavity. At this location, the teeth are arranged in an arch; and as a result, the handle of a conventional tooth brush can collide with the lips and the tongue to thereby also prevent the user from holding the brush head portion 9 in a level orientation. As a result, only a portion of the bristles of a conventional tooth brush, at any location in the mouth, are operable for cleaning the facial surfaces of the teeth.

In order to permit the user to hold the brush head portion 9 in a level orientation for increased brushing efficiency, the mean height of the brushing surface 10, normal to the brush head portion 9, preferably increases from the distal end 11 to the proximal end 13 and the handle portion 20 is preferably angled away from the brisles associated with the brush head portion 9 in the plane thereof. The handle portion 20 of the present invention because of its angled orientation can thereby clear the teeth in the front of the the oral cavity when the user brushes the molars and the associated gingival regions thereof. However, there exists a limitation in the degree to which the handle portion 20 can be angled before the handle portion 20, while in use, collides with the teeth associated with the opposite jaw. Therefore, the brushing surface 10 is preferably angled away from the handle portion 20 to further aid in preventing interferance between the handle portion 20 and the teeth situated in the front of the oral cavity. Moreover, the angled brushing surf,ace 10 can also easily reach into the aforementioned vestibular regions towards the back of the oral cavity with the attendant space limitions thereof.

In accordance with the above discussion, in the preferred embodiment, the convex region 12 can have a maximum height of about 9 mm. and the convex region 16 can have a maximum height of about 12 mm. As illustrated in FIG. 1, the handle portion 20 is angled away from the bristles in the same plane thereof at an angle 'A'. This angle 'A' can be between about 25 degrees to about 35 degrees. An angle of about 35 degrees is however preferred. It is understood however that the advantageous brushing surface of the present invention could be utilized in a conventional toothbrush having a stright handle, not angled away from the bristles of the brushing surface, with of course the concommitant loss of advantageous operation as described above.

The bristles, in a manner well known in the art are inserted into a series of openings in brush head portion 9 and fixed in place. Such an opening is typically illustrated as opening **16*b*''' for tuft 16*b*. In this regard, the dental appliance 1** of the present invention can be constructed in the same manner as a conventional tooth brush from plastics such as nylon using fabrication techniques that are well known in the art.

The dental appliance of the present invention is used in much the same manner as a conventional tooth brush. The user holds the dental appliance 1 of the present invention so that the bristles are angled at a 45 degree angle with respect to the facial surface of the teeth and sulcular areas and gently moved, several times in foward and backward directions. The brush is then lifted and moved to the adjacent teeth where the procedure is repeated.

It will be understood by those skilled in the art that the invention has been described with reference to an exempliary preferred embodiment and that variations and modifications, other than those previously described, can be effected in the described embodiment without departing from the spirit and scope of the invention.

What is claimed is:

1. A dental appliance for cleansing the gingival one third areas of the teeth of a user as well as the sulcular and the embrasure regions thereof, said dental appliance comprising:

a brush head portion of elongate configuration having:

a proximal end, a distal end, and a length as measured from the said distal end to the said proximal end;

a plurality of tufts of bristles disposed along the said length of said brush head portion in a single phase, with each of said tufts of bristles being connected at one end to said brush head portion, said tufts of bristles being sized so as to define an undulating brushing surface formed from the other of the ends of said tufts of bristles, said brushing surface including:

a plurality of convex regions, each of which is configured to coincide with a portion of the free gingival margin adjacent to the facial surface of a selected, adult tooth, said convex regions of said tufts of bristles including at least one located at the said distal end of said brush head portion which is configured to coincide with a portion of the said free gingival margin adjacent to the facial surfaces of an average, adult molar, a plurality of concave regions located adjacent to and alternating with the said convex regions of said tufts of bristles, said concave regions of said tufts of bristles being configured to coincide with the average of the interproximal margins that are located between the said selected teeth used in configuring the said convex regions of said tufts of bristles situated on either side thereof, said concave regions located adjacent to the said one convex region at the said distal end of said brush head portion having the configuration of the average interproximal margin that is located between adult molar teeth, and a mean height, as measured in a direction normal to said brush heat portion, that increases from the said distal end of said brush head portion to the said proximal end of said brush head portion;

a handle portion of elongate configuration connected to said brush head portion at the said proximal end thereof; and a neck portion connecting said handle portion to said brush head portion.

2. The dental appliance of claim 1 wherein said handle portion is angled away from said bristles in the said plane thereof so as to form an angle of between about 25 degrees to about 35 degrees with the said brush head portion.

3. The dental appliance of claim 2 wherein said molar comprises a first molar.

4. The dental appliance of claim 3 wherein, at the said proximal end of said handle portion, said convex regions of said tufts of bristles coincides with a portion of the said free gingival margin adjacent to the facial surfaces of an average adult, upper incisor tooth.

5. The dental appliance of claim 4 wherein said brushing surface includes a set of three convex regions of said tufts of bristles and a set of two concave regions of said tufts of bristles, wherein the central of said convex regions coincides with a portion of the free gingival margin adjacent to the facial surface of an average adult, lower incisor tooth and wherein said concave regions of said tufts of bristles located between said convex regions of said tufts of bristles having the respective configuration of the portions of the free gingival margin adjacent to the facial surfaces of said lower incisor tooth and said upper incisor tooth comprises the configuration of the average of the interproximal margins located between upper and lower incisor teeth.

6. The dental appliance of claim 5 wherein said tufts of bristles are arranged in a single row along the said length of said brush head portion.

7. The dental appliance of claim 6 wherein each of said tufts of bristles spread radially from the said one end thereof connected to said brush head portion and wherein the said other of said ends of each of said tufts of bristles touch the said adjacent tufts of bristles at their said other ends thereof.

8. The dental appliance of claim 7 wherein each bristle in each of said tufts of bristles and each of said tufts of bristles are rounded at the said other of the ends thereof.

9. The dental appliance of claim 8 wherein said handle portion forms an angle of about 35 degrees with said brush head portion.

10. The dental appliance of claim 9 wherein said brush head portion has a circular crossection.

11. The dental appliance of claim 10 wherein said tufts of bristles at the said proximal end of said brush head portion has a maximum height of about 12 mm. and said tufts of bristles at the said distal end of said brush head portion has a maximum height of about 9 mm.

* * * * *